US005575638A

United States Patent [19]

Witham et al.

[11] Patent Number: 5,575,638

[45] Date of Patent: Nov. 19, 1996

[54] STOVE BURNER SIMMER CONTROL

[75] Inventors: David L. Witham, Huntington Beach; Michael W. Barbato, Manhattan Beach, both of Calif.

[73] Assignee: Thermador Corporation, Los Angeles, Calif.

[21] Appl. No.: 371,597

[22] Filed: Jan. 12, 1995

Related U.S. Application Data

[63] Continuation of Ser. No. 219,388, Mar. 29, 1994, abandoned.

[51] Int. Cl.[6] ..... F23N 5/00

[52] U.S. Cl. ..... 431/73; 431/1; 431/266; 126/39 BA; 126/39 E; 126/39 G

[58] Field of Search ..... 431/24, 18, 266, 431/254, 1, 73, 78, 80; 126/39 R, 39 BA, 39 E, 39 G, 39 J, 39 H

[56] References Cited

U.S. PATENT DOCUMENTS

| | | | |
|---|---|---|---|
| 3,734,681 | 5/1973 | Perl | 126/39 J |
| 3,845,582 | 11/1974 | Capy | 431/1 |
| 3,942,078 | 3/1976 | Simeau | 315/209 |
| 4,324,542 | 4/1982 | Challet | 431/78 |
| 4,376,626 | 3/1983 | Rossi | 431/73 |
| 4,457,701 | 7/1984 | Gaiffier | 431/24 |
| 4,467,783 | 8/1984 | Hurley | 126/378 |
| 4,724,823 | 2/1988 | Simpson | 431/1 |
| 5,003,960 | 4/1991 | Hanagan | 431/27 |
| 5,074,780 | 12/1991 | Erdman | 431/24 |
| 5,241,463 | 8/1993 | Lee | 126/39 BA |
| 5,329,918 | 7/1994 | Di Bari | 126/39 BA |

*Primary Examiner*—James C. Yeung
*Attorney, Agent, or Firm*—Brooks & Kushman P.C.

[57] ABSTRACT

A burner control provides a pulsed flame sequence in response to a user's selective manipulation of an actuator through a range of response. A microcontroller-based control module switches both a burner ignitor control and an electric valve for gas supply to the burner in a predetermined time sequence depending upon the actuator position within the predetermined range. Preferably, one or more of a plurality of burners on a single cooking top are controlled for pulsed sequence operation, and a single actuator for each channel, preferably in a form of a rotary knob, provides a simple user interface for utilizing the pulsed flame sequence, preferably in a low gas flow or simmer cooking range.

13 Claims, 3 Drawing Sheets

FIG 1
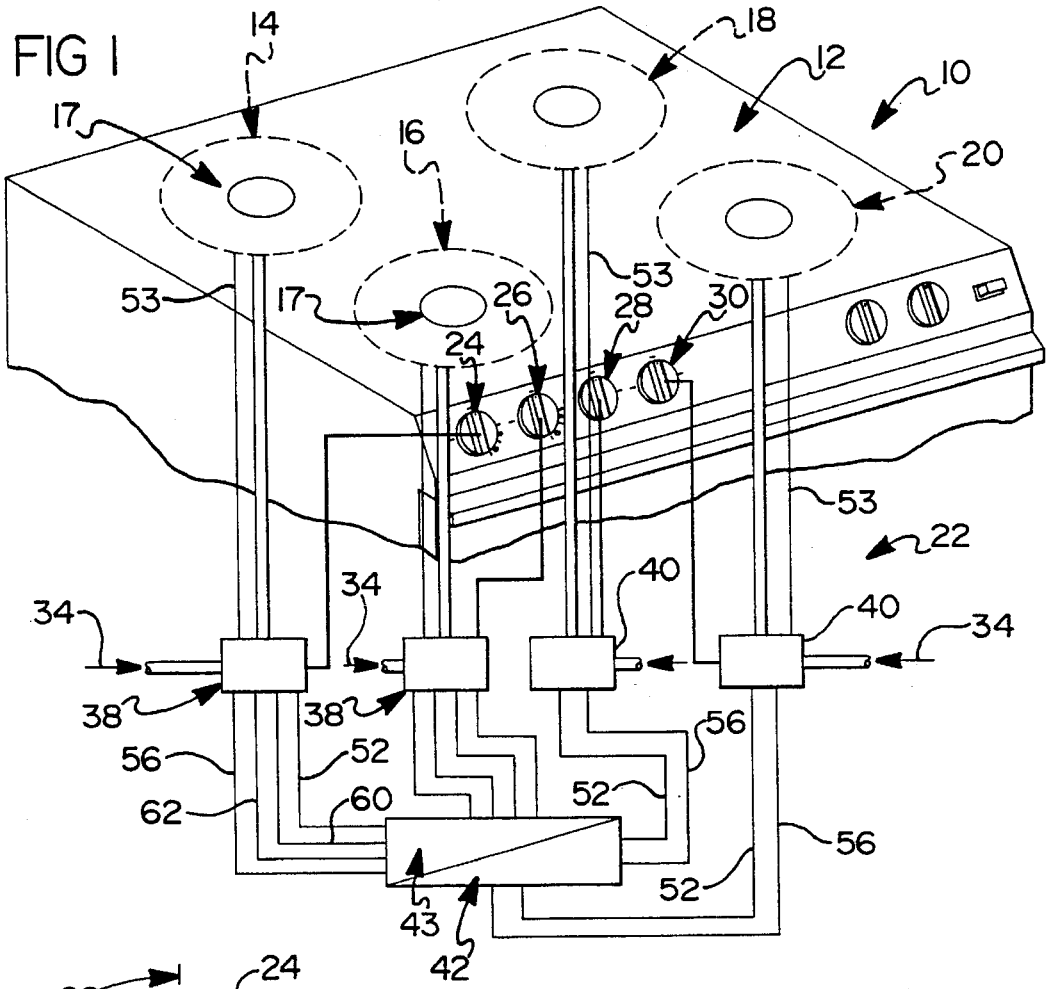
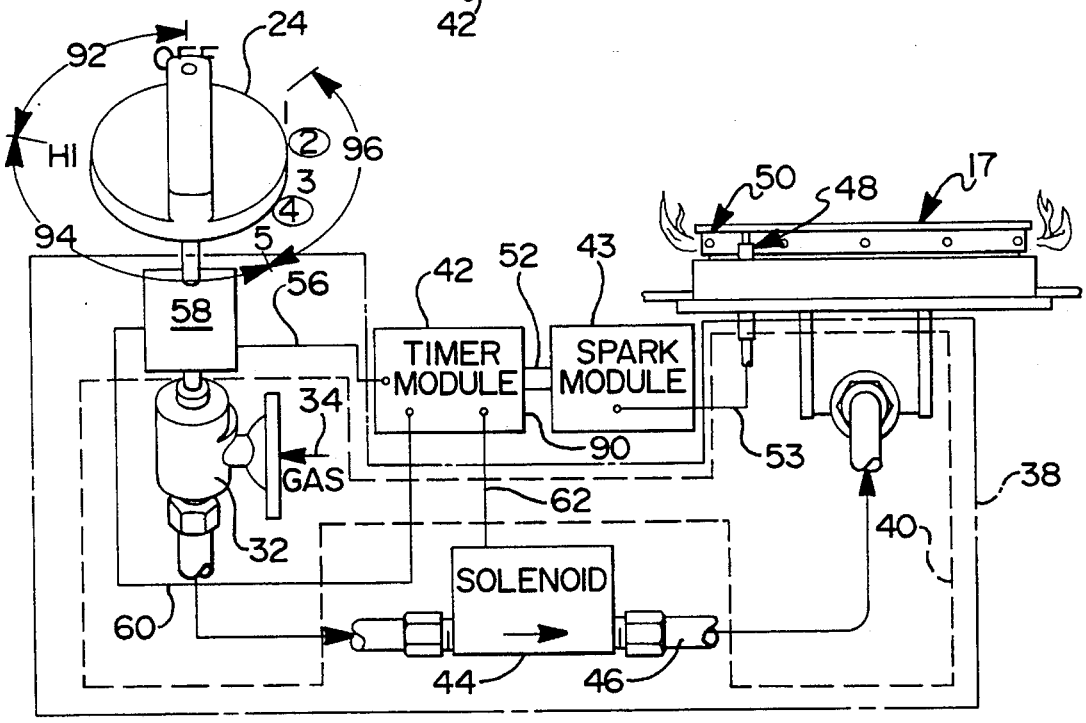
FIG 2

STOVE BURNER SIMMER CONTROL

This is a continuation of application Ser. No. 08/219,388 filed on Mar. 29, 1994, abandoned.

FIELD OF THE INVENTION

The present invention relates generally to burner controls for stoves, and more particularly to a control for simultaneously actuating a reignitor and a gas line valve for periodic sequencing of a burner flame.

BACKGROUND ART

Previously known burners and burner controls for stoves employed in cooking appliances often incorporate a dual proportional gas valve for controlling the amount of gas delivered to the burner that generates a flame in response to a spark delivered to an ignitor at the burner. Most often, rotation of a knob proportionally controls the opening and the closing of the valve to control the amount of gas delivered to the burner and thus the size of the flame delivering heat to the cooking vessel. Moreover, a predetermined rotation of the knob also controls delivery of a charge to the ignitor. Nevertheless, these simple burner controls maintain a constant flame even during a simmering cooking step and thus provoke hot spots in the receptacles placed on the burner. Moreover, to assure a low flame when a low heat transfer is desired, the cooking tops have been constructed to include small burners so that a low BTU output may be maintained. However, such low but constant flame output typically results in uneven heat distribution throughout the cooking receptacle resulting in hot spots. Moreover, the low BTU output of a very small flame can also create problems with previously known flame sensing circuitry of a spark rectification system often used in gas appliances to assure that gas delivered to the burner is combusted.

Another previously known cooking top employing a burner control to address the above problems comprises a system for pulsing the flame so that the flame is on or off for selected period of time within a cycle. However, the previously known controls for such burners have been complicated to operate in that multiple controls are used to control gas flow and the operation of the ignitor at the burner. In particular, Scholtes of Thionville, France and Rosiere marketed burner controls employing an electronic sequencer from R. V. Construction électriques of Balvozy, France in which one actuator was used to periodically control ignitor timing periods while another actuator controls the volume of gas passed through the valve. Accordingly, the cook was required to maintain control over two actuators simultaneously in order to properly operate the stove at a desired cooking condition.

Another previously known burner control provides an actuator that presets a desired temperature for a cooking vessel. An electronic circuit controls the flame on and flame off time to maintain a set temperature in response to a sensor which touches the bottom of the cooking vessel. The amount of gas flow to maintain this temperature setting is modulated by a temperature responsive, gas flow control valve. However, the temperature sensor is subjected to continuously changing heating and cooling cycles and can substantially affect the durability of many of the components subjected to cycling in the cooking apparatus.

SUMMARY OF THE INVENTION

The present invention overcomes the above-mentioned disadvantages by providing a burner system in which the ignitor and the supply of gas are simultaneously controlled in response to a single actuator. A sequencing module including a microcontroller is responsive to the actuator for timing the charge delivered to a reignitor of a burner channel while the simultaneously operating solenoid valve which varies the supply of gas to the burner in a periodic sequence. The gas supply is also valved to simultaneously proportion the gas flow volume as the sequencing period is selected so as to provide a proper volume of gas to the burner during each period in response to the users operation of the actuator. As a result, the present invention substantially simplifies a cook's control over the heat to be supplied by the burner to be employed in a cooking operation.

Preferably, the stove includes a plurality of burners, and any one or combination of the burners can be adapted to include the sequencing control. In a preferred embodiment, a common sequencing controller selectively operates a plurality of burners in response to a like plurality of burner control actuators, although only two of the burner channels in the stove of the preferred embodiment employ the periodic sequencing function of the controller. In the preferred embodiment, the actuators are in the form of rotary knobs wherein a first range of rotary movement adjusts the BTU output of the proportioning valve by controlling the volume of gas flowing between the gas supply and the burner. Another rotary range of the knob operates the periodic sequencing control to turn the flame on and off for predetermined amounts of time by simultaneously controlling charges to the ignitor and gas flow to the burner. Preferably, the second range permits the cook to achieve varying degrees of low simmer conditions.

In addition, the control also includes a low voltage lock out that prevents operation of a burner channel when the input voltage is less than a predetermined voltage so that the channel is inoperative if input voltage is insufficient to cause a proper charge at the ignitor of the burner. In addition, the burner control includes a disabling circuit responsive to a power failure to disable gas flow and ignitor operation until a control knob is returned to the off position after power has been restored.

As a result, the present invention provides a sequence burner control channel that simplifies a cooks interaction with the cooking appliance while providing precision control of the cooking operation by precisely gauging heat transferred to the cooking vessel. In addition, the present invention provides a cooking appliance in which a plurality of burners can be operated by a single controller module while one or more of the channels provide a sequenced flame operation. Accordingly, the present invention provides substantially greater control over cooking operations than previously known burner operating systems.

BRIEF DESCRIPTION OF THE DRAWING

The present invention will be more clearly understood by reference to the following detailed description of a preferred embodiment when read in conjunction with the accompanying drawing in which like reference characters refer to like parts throughout the views and in which:

FIG. 1 is a diagrammatic of a view of a cooking apparatus including a burner control system according to the present invention;

FIG. 2 is a diagrammatic representation of a burner channel for the system shown in FIG. 1;

DETAILED DESCRIPTION OF A PREFERRED EMBODIMENT

Figure 3:
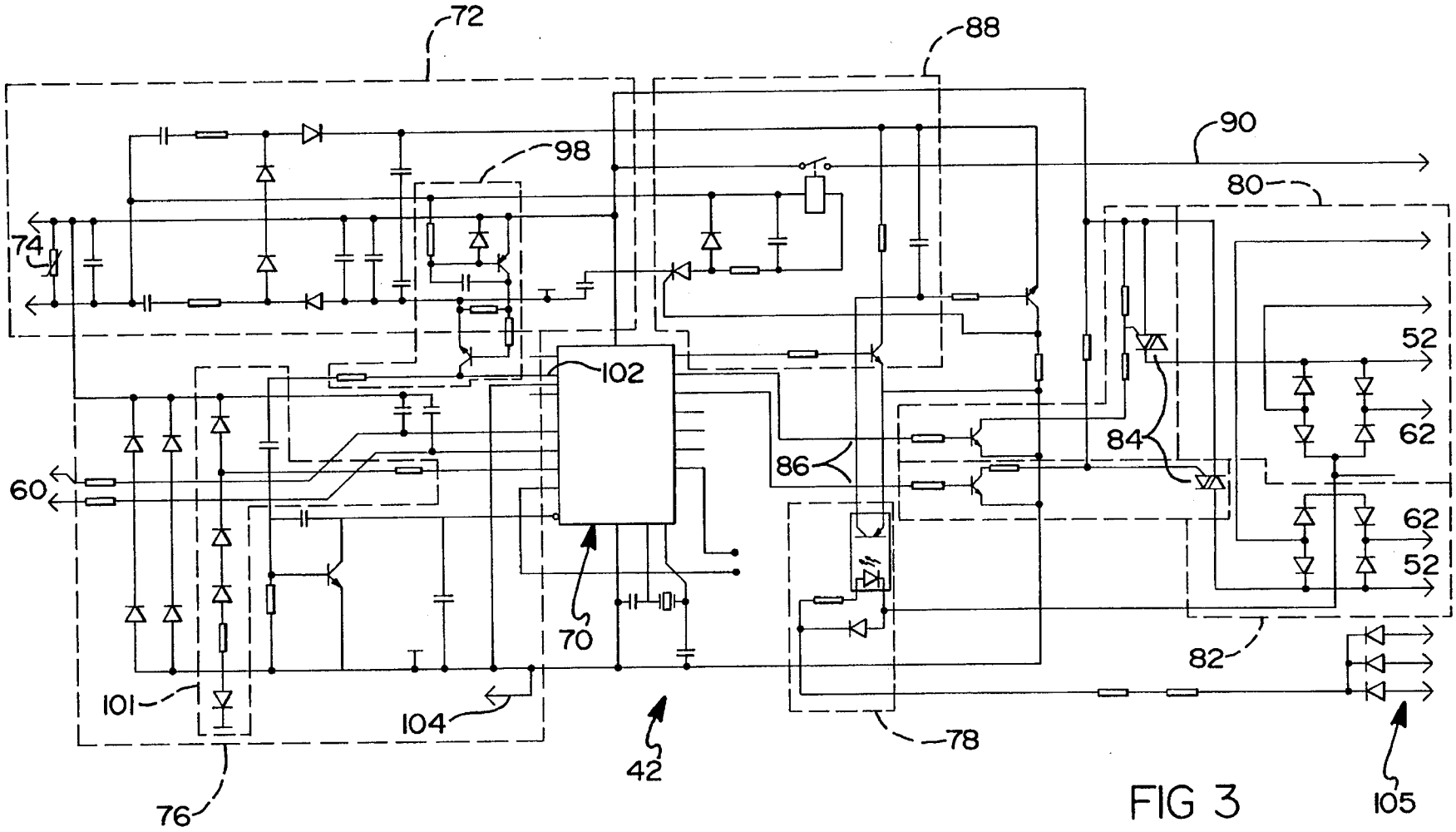
FIG. 3 is a schematic diagram of a portion of the control module operating the channel shown in FIG. 2.

Referring first to FIG. 1, a stove 10 includes a cooking top 12 with four burners 14, 16, 18 and 20. Burners 14, 16, 18 and 20 are shown by dashed indicia to represent that the burners are mounted on a surface layer such as a glass top or enameled steel. A cooking top burner control system 22 includes an actuator 24, 26, 28 and 30 for each of the burners 14, 16, 18 and 20 respectively. As shown in FIG. 1, burners 14 and 16 include pulse sequence control in accordance with the present invention, while burners 18 and 20 operate in a conventional proportional valving operation in response to rotation of the actuators 28 and 30 and need not be further described in detail.

As shown in FIGS. 1 and 2, each of the actuators 24–30 is coupled to a control mechanism including a valve 32 for controlling the volume of gas delivered from a gas supply 34. In addition, the control apparatus coupling the actuators 24 and 26 to the burners 14 and 16, respectively, is formed by a control mechanism 38 as shown in phantom line in FIG. 2. The actuators 28 and 30 are coupled to the burners 18 and 20 through a control apparatus 40 represented in the dashed line 40 in FIG. 2. These figures also demonstrate that each of the burner channels preferably share access to a common sequencer control 42 and common spark control 43 as will be described in greater detail throughout the description.

Referring now to FIG. 2, the diagrammatic representation displays the burner channel for operating burner 14 in response to actuator 24, although it is to be understood as also including a typical embodiment of a burner channel 40 without pulse sequenced operation, to show the relative connections with the common module 42. Nevertheless, the control apparatus 40 differs from the control apparatus 38 by reason of the solenoid valve 44 in the gas line 46 coupling the valve 32 to the burner cap 17. In addition, the input 60 from potentiometer 58 to the control module 42 is included in the channel 38.

Each burner includes an ignitor 48 exposed to the gas outlet 50 to generate a flame when a charge is provided to the ignitor or spark plug 48 by a signal from the module 42 positioned along the conductor 52 to spark module 43 that generate a high voltage signal along conductor 53. Another common element between the control apparatus 38 and the control apparatus 40 is that a switch 54 communicates through conductor 56 with the controller module 42 so that the spark module, such as a Technical Component's RI325 gas reignitor unit, is provided with a 120 volt output as necessary. The preferred spark module includes both ignition spark generation high voltage circuits and low voltage flame detection circuits that monitor the presence of a flame and charge the ignitor 48 if the flame is removed while the gas flow continues. The spark module 43 provides power to each reignitor 48 only when a sequenced or unsequenced channel has been selected for operation by movement of the respective actuator 24–30.

After a power failure has occurred and power is restored to the stove, the sequencing controller 42 disables the sequenced gas and all electrical outputs until the respective actuator for the inoperative channel is returned to the OFF position for resetting the controller 42. A controller module 42, for example, a simple input control and output system based on a microcontroller, such as Thompson 8 bit microcontroller 70, will be described in greater detail with respect to FIG. 3. The spark controller 43 may be of a known type such as a Technical Components Model SQ001.

Still referring to FIG. 2, a potentiometer 58 (FIG. 4) of the channel control 38 is operated in response to movement of the actuator 24, to provide an output delivered by conductor 60 to the module 42. The module analyzes the input from the potentiometer 58 in order to provide an additional control signal along conductor 62 to the solenoid 44 in the gas path 46. The solenoid 44 preferably is a normally closed solenoid such as a KIP, Inc. valve no. U343117-0251 so that absence of a signal along conductor 62 maintains the solenoid in a closed position which blocks the flow of gas toward the burner 17.

Figure 4:
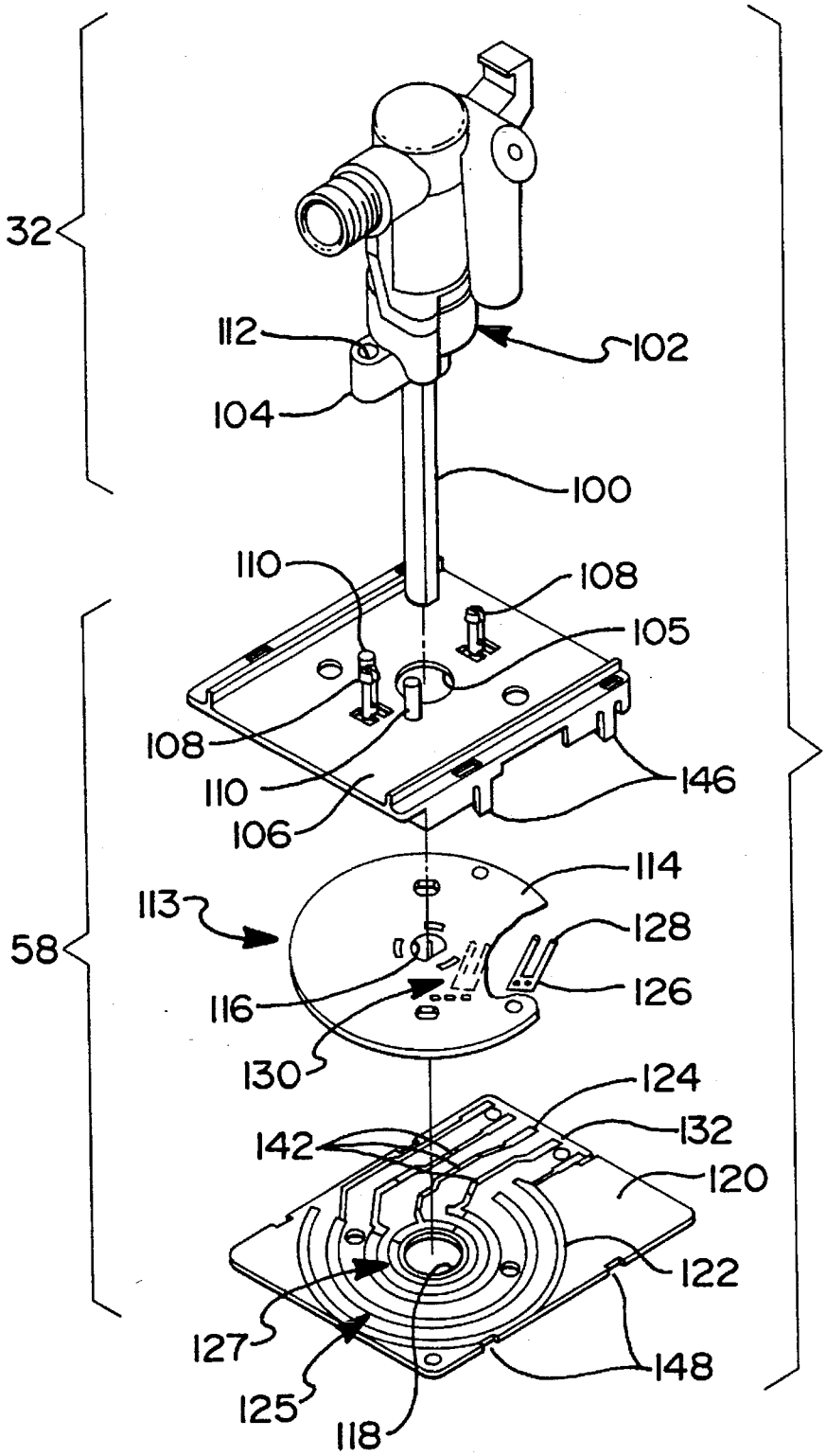
FIG. 4 is an exploded perspective view of a preferred switch and valve combination for a burner control system according to the present invention.

Referring to FIG. 4, a preferred embodiment of an actuator 24 including responsive control elements combines a potentiometer switch and a valve. The combination includes a compact potentiometer coupled for response to the valve actuator stem 100 extending out of the valve body 102. The valve body includes a mounting boss 104 for mounting a potentiometer support plate 106 by means of the resiliently expanding split prongs 108 securingly engageable in apertures 112 of the boss 104. Alignment pins 110 engage opposite sides of the boss 104 to maintain proper orientation of the potentiometer. The aperture 105 and the support plate 106 receives the stem 100 for rotation therein.

A rotary contact member 113 is carried by the shaft 100 for rotation therewith. For example, the rotor plate 114 has a central aperture 116 with a flattened periphery corresponding to the cross sectional shape of the stem 100. The rotor plate 114 also has a resiliently expanding split prong plug adapted to be rotatably retained within an opening 118 in a trace board 120. The trace board carries a plurality of arcuate resistive traces 122 bonded to conductive traces 124. Conductive terminals on an end of the board 120. A pair 125 of the outermost traces 122 are coupled by a two prong conductive wiper 126 with conductive end points 128 carried by the rotor plate 114. The wiper points 128 are resiliently engaged against the outermost arcuate traces 122 as the wipers are mounted to extend at an angle to the flat surface of the rotor. Likewise, the innermost pair 127 of arcuate traces are engaged by a similarly mounted contact 130 carried by the rotor blade 114. Intermediate resistive trace portions 140 between conductive terminals 142 at the prong 132 and the resistive arcuate traces 122 cover portions of the path traversed by the contacts 126 and 130 across the board 120 when the actuator 24 positions the stem 100 for operation in the range 92 discussed in greater detail with respect to FIG. 2.

In addition, the potentiometer is particularly useful in the actuator range 96, as will be discussed in greater detail with respect to FIG. 2, where the varying resistance between the terminals on the prong 132 are delivered through conductors to the control unit to control the on-time for the burner in the sequencing mode range 96 of operation. The assembly shown is very compact and easily packaged with the valve 102 so as to form a multiple-operation burner control which is simple to use and operate since only a single actuator is associated with each burner. The fingers 146 on the plate 106 include hooks to resiliently engage notches 148 in the board 120 and enclose the rotor 113 between the plate 106 and the board 120.

In addition, while the rotation of the stem 100 operates the rotor 114 for corresponding electrical signaling of the position of the actuator through the prong 132 to the conductor for signal 60, the stem 100 also controls the position of the valve so as to open the valve fully at about a 90° position from the fully clockwise rotational position. As the stem 100 is further rotated from about 90° to about 210°, as designated by the range 94 in FIG. 2, the flow of gas through the valve decreases substantially linearly as the flow rate changes over the rotational positions. At about 210°, the actuator approaches range 96 at which the flow rate remains relatively constant at about ⅙ the maximum flow rate through the valve. Within the range 96, the flow of gas to the burner is governed solely by the solenoid valve 144 in response to the control signal 62 generated by control unit 42. The control signal 62 sent to the solenoid is likewise dependent upon the signal received from the potentiometer from signal conductor 60.

Referring now to FIG. 3, the preferred embodiment of the control module 42 includes a plurality of circuits as well as programmed controller operation providing input to a microcontroller such as an ST 6210 I.C. as shown at 70. The module 42 includes a power supply 72 adapted to receive a mains power at connection 74 which provides both the filtered 120 volt AC power to be supplied to the reignitor as well as the 120 volt DC rectifier output to be applied to the gas solenoid in each channel. The power supply 74 also generates the 5 volts DC required for operating the digital microcontroller 70. To reduce the physical size and costs of the controller unit 70, the 5 volt power supply is referenced to the line voltage in such a manner that the negative DC supply is −5 volts and the positive DC supply 5 volts is the line voltage.

The module 42 also includes an input stage 76 that monitors the voltage of each potentiometer 58 at each conductor 60 to determine the angular orientation or rotary position of the knob 24, the related switching mechanism, and the corresponding controller operation used to control the ON, OFF and sequencing timing of the burner 17. The potentiometer is referenced to the controller's DC supply by direct connection between line voltage and the negative D.C. supply connection 104. This ensures the signal is ratiometric and unaffected by supply variations. The microcontroller input is protected against noise and interference generated by the harsh stove environment by clamping diodes and suitable resistive and capacitive filtering as shown in FIG. 3.

Timing pulses used to calculate the sequencing timing are generated by zero crossing circuitry as shown at 98. The mains voltage is converted to logic level pulses for direct connection to the microcontroller input, with filtering to remove interference spikes that generate random rather than timing pulses and that would affect timing accuracy.

Another feature of the module 42 is an under voltage lockout 101. When the input voltage falls below a specified voltage minimum, for example, 95 volts, the operation of the reignitor and the gas solenoid become unpredictable. To ensure that the reignitor is capable of sparking at any time that the gas valve 32, or the pair of valves 32 and 44 in a control channel 38, is open, the circuitry generates a logic level pulse 90° after the main zero crossing point detected at 98. This logic signal is used to control the lockout of solenoid valve 44 as well as the reignitor 48 until the minimum specified operating voltage is restored. In the event of total power loss while operating, each actuator must be reset to the zero position to reactivate each burner channel when power is restored. Likewise, when the supply voltage remains below a specified minimum for more than a predetermined time, for example, 95 volts or other selected voltage in the preferred range of 88 VAC–102 VAC, for more than 0.5 seconds, a lockout prevents gas flow and ignitor actuation.

In addition, the module 42 used in the system 22 shown in FIG. 1 includes a pair of output stages 80 and 82. Each stage includes a semiconductor switch, for example, the triacs 84 and related control circuitry, to provide 120 volt AC current to the reignitor at outputs 52 and DC output from a full wave rectifier at output 62. To reduce conducted and radiated emissions, the triacs are directly driven by microcontroller as at 86 and activated continuously for the period required to be on. In addition, a relay circuit 88 controls the application of 120 volt AC voltage to the switch line connection 90 directed to the power connection of the spark module 43. The relay circuit 88 is activated during periods that outputs 62 and 52 are operating. The burners not controlled by solenoid valves have related switching mechanisms connected at 105 that can activate the relay 88 or 43 by circuitry 78 independently of microcontroller 70.

In addition, the microcontroller 70 includes several programmed operations. As the mains voltage changes from negative to positive at a zero crossing, a non-maskable interrupt detected at 102 occurs so that the microcontroller 70 updates a counter representing the sequencing period. On completion of the interrupt, the main program routing commences where both potentiometers 58 of the system 22 are read, and each reading is used to calculate the duty cycle of each sequence signal delivered to a sequenced burner channel. The duty cycle is the ON-time in a sequencing period of 60 seconds. Each channel is checked to determine if the sequencing period count exceeds the calculated ON-time count. The channel output remains ON only while the sequencing period count does not exceed the ON-time count. The outputs 62 to the solenoid and 52 to the spark module 43 are switched off or on depending on the ON-time calculation of the previous mains cycle. The main program finishes execution before the mains voltage reaches the peak at 90 degrees phase shift beyond the zero crossing. A timer interrupt that occurs at the peak of the mains cycle is used to calculate if the line voltage is less than a voltage between 88 to 102 volts AC, and switches off the reignitor and the gas solenoid by stages 80 and 82.

The timing for sequencing is derived from the 60 hertz line voltage with each 60 second sequencing period equivalent to 3600 mains periods. The microcontroller counts the 3600 mains periods at successive non-maskable interrupts (NMI) that occur at the zero crossing point. The NMI interrupt routine requires a series of steps including the detection of a zero crossing, the switching ON or OFF of the gas solenoid output 62 and the switching ON or OFF of reignitor output 52 depending upon the ON or OFF status flag calculated in the previous main cycle. Switching the outputs 52 and 62 at the zero crossing point minimizes conducted or radiated interference to improve longevity of the parts and avoid interference with other circuit operations. In addition, a timer is started for determining the length of a mains under-voltage check. The time period of 4.1666 milliseconds is equivalent to a 90 degrees phase shift. The sequence period counters are incremented. If the counter reaches 3600, the counter is reset to zero before the routine ends.

The main program has a power up cycle checking that both potentiometers 58 in the sequence channels must be turned to the OFF position before the program will continue to operate the module 42 as a control for the output stages 80 and 82. The program loops waiting for a zero crossing to occur. As the non-maskable interrupt (NMI) is executed by microcontroller 70 at the zero crossing, the sequence period count is compared to a previously calculated ON-time. If the sequence period count is less than the ON-time count, an output ON flag is set. If the sequence period count is equal to or greater than the ON-time, the output ON flag is at zero. The flag controls the solenoid output 62 and the reignitor output 52 for a particular channel, switching the outputs ON or OFF during the non-maskable interrupt routine.

The main program then includes alternatively switching the appropriate potentiometer 58 to the analog-to-digital converter. Four successive readings are averaged to calculate the position of the potentiometer. If the potentiometer position is less than a set limit, for example, 75° as shown in the range 92 shown in FIG. 2, the ON-time count equals zero and the relay 88 is turned off. If the position of actuator 24 is greater than 80°, or as shown in the range 94 in FIG. 2, the ON-time count equals 3601 and relay 88 is turned ON. If the position of actuator 24 is greater than 210°, for example, in the range shown at 96 in FIG. 2, the relay 88 is turned ON. When the new position varies by greater than plus or minus 4 bits, a new ON-time is calculated. The ON-time is calculated from a look up table using a potentiometer output 60 to determine an ON-time in the range of 600 to 3240 within the period of zero to 3600 counts. The program then returns to await for another zero-crossing to occur for further updating and control of the channel operation in response to a user's operation of a single actuator to control the burner of each channel.

As a result, the channels 40 having only the valve 32 and the ignitor 48 provide ratiometric control of the gas volume delivered to the burner, and assure proper ignition of any gas delivered to the burner throughout the activator's rotary ranges 92, 94 and 96 shown in FIG. 2. Nevertheless, no gas can be delivered to the burner after a power loss until the actuator is reset to an OFF position. The controllers 38 provide additional flame control so that the flame is ignited only during a portion of each sequential period when the actuator 24 is rotated in the range 96 shown in FIG. 2. In that range, preferably the simmering range for the burner, the module 42 not only controls periodic actuation of the ignitor 48 through the spark control 43, but the operation of the solenoid valve 44 governing access of the output from the proportional valve 32 to the burner outlet 50. As a result, the present invention provides better control of the heat delivered to a cooking vessel positioned on a burner coupled to a control channel including the sequence controller of the present invention, while utilizing a simple actuator for each channel that eases the interface between a user and the appliance.

Having thus described the present invention, many modifications thereto will become apparent to those skilled in the art to which it pertains without departing from the scope and spirit of the present invention as defined in the appended claims.

What is claimed is:

1. A burner control for a burner having an ignitor and a gas conduit coupled to a gas source, the control comprising;

a valve coupled to said gas conduit for selectively delivering a variable volume of gas to said burner from the gas source;

an actuator having a valve control responsive to manipulation of said actuator throughout a predetermined range, an ignitor control for controlling an electrical charge to the ignitor in response to manipulation of said actuator through at least a first portion of said predetermined range; and means for periodic sequencing of the flow of gas and the ignitor charge when said actuator is in said first portion of said predetermined range of said control, including a switch responsive to manipulation of said actuator throughout said first portion for adjusting the period of sequencing.

2. The invention as defined in claim 1 wherein said means for periodic sequencing comprises at least one control module with a microprocessor.

3. The invention as defined in claim 2 wherein said actuator includes a mechanical valve control and said ignitor control comprises a switch for controlling electrical charge to the ignitor in response to manipulation of said actuator through said first portion and a second portion of said predetermined range.

4. The invention as defined in claim 3 wherein said switch comprises a potentiometer with a rotor engaged with said mechanical valve control.

5. The invention as defined in claim 2 wherein said at least one control module includes a power up cycle check for disabling delivery of said variable volume of gas and said electrical charge unless said actuator is returned to a preset limit of said predetermined range.

6. The invention as defined in claim 2 wherein said at least one control module includes an under voltage lockout to disable delivery of said variable volume of gas and said electrical charge if a supply voltage is below a predetermined limit.

7. The invention as defined in claim 2 wherein said at least one control module includes a timer for generating periodic sequencing derived from a mains line voltage signal.

8. The invention as defined in claim 1 wherein said actuator comprises a single rotary knob.

9. A stove having a plurality of burners a source of gas, an ignitor at each burner, and a control channel for at least one of the plurality of burners comprising:

an actuator having a range of response;

a valve coupled to said actuator for controlling delivery of a variable volume of gas from said source to its respective burner;

at least one solenoid valve interposed between the gas source and one said control channel burner;

an ignitor control coupling said actuator to a respective control channel ignitor; a timer control having a periodic sequencing control output for charging said respective control channel ignitor and controlling said solenoid valve for periodic gas flow to its respective burner;

wherein said actuator has a switch for actuating and adjusting said periodic sequencing in said timer control in at least a portion of said range of response.

10. The invention as defined in claim 9 wherein said actuator comprises a rotary knob.

11. The invention as defined in claim 10 wherein said switch comprises a sensor for detecting a predetermined rotary displacement of said knob.

12. The invention as defined in claim 11 wherein said sensor comprises a potentiometer.

13. The invention as defined in claim 9 wherein said stove comprises at least two control channels having said switch for actuating said periodic sequencing control.

* * * * *